US009523361B2

(12) United States Patent
Won et al.

(10) Patent No.: US 9,523,361 B2
(45) **Date of Patent: *Dec. 20, 2016**

(54) SCROLL COMPRESSOR HAVING BACK PRESSURE CHAMBER THAT OPERATIVELY CONTAINS A DISCHARGE PRESSURE AND AN INTERMEDIATE PRESSURE DURING DIFFERENT PERIODS OF TIME WITHIN A SINGLE COMPRESSION CYCLE

(75) Inventors: Inho Won, Seoul (KR); Yanghee Cho, Seoul (KR); Kitae Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/346,835

(22) Filed: Jan. 10, 2012

(65) Prior Publication Data

US 2012/0177523 A1 Jul. 12, 2012

(30) Foreign Application Priority Data

Jan. 11, 2011 (KR) ..... 10-2011-0002846
Jan. 11, 2011 (KR) ..... 10-2011-0002848

(51) Int. Cl.
*F04C 18/02* (2006.01)
*F04C 27/00* (2006.01)
(Continued)

(52) U.S. Cl.
CPC ..... *F04C 18/0207* (2013.01); *F01C 17/066* (2013.01); *F04C 18/0253* (2013.01);
(Continued)

(58) Field of Classification Search
CPC ... F01C 1/0215; F04C 2250/10; F04C 23/008; F05B 2250/50
(Continued)

(56) References Cited

U.S. PATENT DOCUMENTS 4,596,521 A * 6/1986 Murayama et al. ..... 418/55.1
4,649,611 A 3/1987 Ikeda et al.
(Continued)

FOREIGN PATENT DOCUMENTS

CN 1276484 12/2000
CN 1427160 7/2003
(Continued)

OTHER PUBLICATIONS

English Machine Translation of Abstract of JP 411044295A.*
(Continued)

*Primary Examiner* — Nicholas J Weiss
*Assistant Examiner* — Paul Thiede
(74) *Attorney, Agent, or Firm* — KED & Associates, LLP

(57) ABSTRACT

A scroll compressor is provided. The scroll compressor may include a case; a fixed scroll installed in the case; a wrap portion configured to form a compression chamber by being engaged with the fixed scroll; a base portion coupled to the wrap portion so as to be movable with the fixed scroll but not rotate in a circumferential direction; a drive motor coupled to a rear surface of the base portion, and configured to eccentrically rotate the base portion and the wrap portion; and a main frame installed in the case, and configured to support the base portion. A back pressure chamber that communicates with the compression chamber may be formed between the wrap portion and the base portion where a pressure of the back pressure chamber corresponds to a discharge pressure or an intermediate pressure between the suction pressure and the discharge pressure.

11 Claims, 7 Drawing Sheets

(51) Int. Cl.
*F01C 17/06* (2006.01)
*F04C 23/00* (2006.01)

(52) U.S. Cl.
CPC ..... *F04C 23/008* (2013.01); *F04C 27/005* (2013.01); *F04C 27/007* (2013.01); *F04C 27/008* (2013.01)

(58) Field of Classification Search
USPC ..... 418/55.5, 55, 55.3
See application file for complete search history.

(56) References Cited

U.S. PATENT DOCUMENTS

| | | | | |
|---|---|---|---|---|
| 6,227,831 | B1 | 5/2001 | Osima et al. | 418/55.4 |
| 6,755,632 | B1 | 6/2004 | Ito et al. | |
| 6,776,593 | B1 * | 8/2004 | Cho | 418/55.3 |
| 7,195,470 | B2 | 3/2007 | Kimura et al. | |
| 2012/0164014 | A1 | 6/2012 | Nagahara et al. | 418/55.1 |
| 2012/0177523 | A1 | 7/2012 | Won et al. | 418/55.5 |
| 2013/0121865 | A1 | 5/2013 | Jang et al. | 418/55.1 |
| 2013/0121866 | A1 | 5/2013 | Jang et al. | 418/55.5 |

FOREIGN PATENT DOCUMENTS

| | | | | |
|---|---|---|---|---|
| CN | 101142409 | A | | 3/2008 |
| CN | 100532847 | C | | 8/2009 |
| CN | 100538077 | C | | 9/2009 |
| CN | 101900115 | | | 12/2010 |
| CN | 101988497 | | | 3/2011 |
| DE | 196 42 798 | A1 | | 11/1997 |
| EP | 1 059 447 | A1 | | 12/2000 |
| JP | S53119412 | A | | 10/1978 |
| JP | 59-079091 | A | | 5/1984 |
| JP | 60-252185 | A | | 12/1985 |
| JP | 61-192882 | A | | 8/1986 |
| JP | 63-106386 | A | | 5/1988 |
| JP | 63-106387 | A | | 5/1988 |
| JP | 05-149270 | A | | 6/1993 |
| JP | 11044295 | A | * | 2/1999 |
| JP | 2003-232285 | A | | 8/2003 |
| JP | 2010-007550 | A | | 1/2010 |
| KR | 10-2001-0007061 | A | | 1/2001 |
| WO | WO 2007/114531 | A1 | | 10/2007 |
| WO | WO 2011/027567 | | | 3/2011 |

OTHER PUBLICATIONS

CN Office Action dated Jan. 3, 2014 for corresponding Application No. 201210018076.8.
Korean Office Action issued in Application No. 10-2011-0116636 dated Jan. 29, 2013.
Korean Office Action issued in Application No. 10-2011-0116640 dated Feb. 4, 2013.
Korean Office Action issued in Application No. 10-2011-0116641 dated Feb. 4, 2013.
European Search Report issued in Application No. 12 19 1845 dated Feb. 11, 2013.
Korean Office Action issued in Application No. 10-2011-0116641 dated Jul. 30, 2013.
Korean Notice of Allowance issued in Application No. 10-2011-0116636 dated Oct. 29, 2013.
Office Action dated Jul. 16, 2014, issued in U.S. Appl. No. 13/672,829.
Chinese Office Action dated Aug. 22, 2014. (Translation) (201210018076.8).
U.S. Appl. No. 13/672,829, filed Nov. 9, 2012.
Chinese Office Action dated Dec. 1, 2014.
Chinese Office Action dated Dec. 9, 2014.
Office Action issued in U.S. Appl. No. 13/672,829 dated Mar. 26, 2015.
Office Action issued in U.S. Appl. No. 13/672,846 dated Mar. 27, 2015.
Chinese Office Action issued in Application No. 201210447408.4 dated Aug. 14, 2015.
U.S. Office Action issued in co-pending U.S. Appl. No. 13/672,846 dated Oct. 8, 2015.
U.S. Appl. No. 13/672,846, filed Nov. 9, 2012.
U.S. Office Action dated Aug. 5, 2016 issued in co-pending U.S. Appl. No. 13/672,846.

* cited by examiner

SCROLL COMPRESSOR HAVING BACK PRESSURE CHAMBER THAT OPERATIVELY CONTAINS A DISCHARGE PRESSURE AND AN INTERMEDIATE PRESSURE DURING DIFFERENT PERIODS OF TIME WITHIN A SINGLE COMPRESSION CYCLE

CROSS-REFERENCE TO RELATED APPLICATION(S)

This application claims priority to Korean Patent Application Nos. 10-2011-0002846 and 10-2011-002848, filed in Korea on Jan. 11, 2011, which are hereby incorporated by reference in their entirety for all purposes as if fully set forth herein.

BACKGROUND

1. Field

A scroll compressor with a split type orbiting scroll is disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
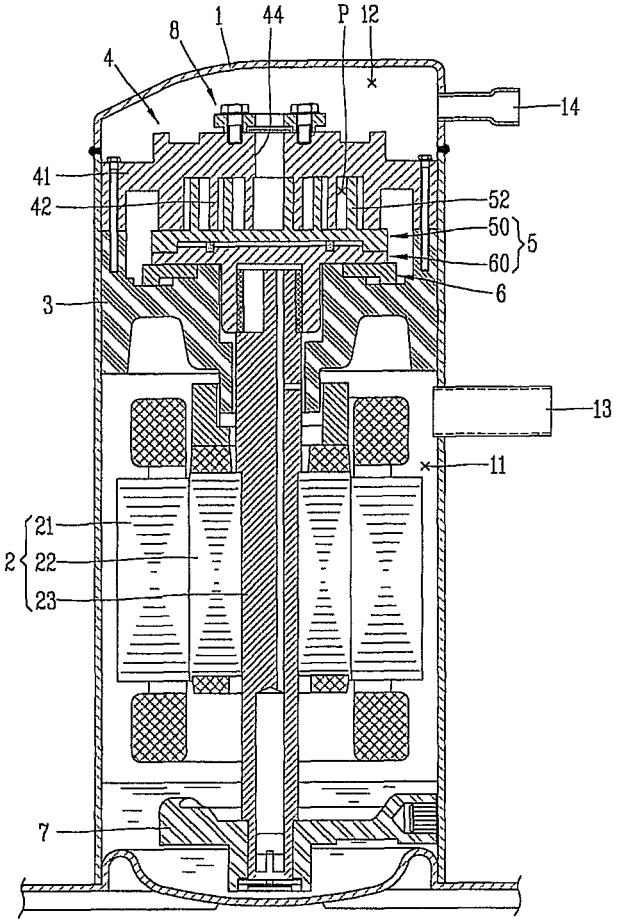
FIG. 1 is a cross-sectional view of a scroll compressor according to an embodiment.

Description will now be given in detail of embodiments, with reference to the accompanying drawings. Where possible, like reference numerals have been used to indicate like elements, and repetitive description has been omitted.

Hereinafter, a scroll compressor according to embodiments will be explained in detail with reference to the attached drawings.

Generally, a scroll compressor is a compressor that compresses a refrigerant by changing a volume of compression chambers formed by a pair of scrolls that face each other. Scroll compressors are widely applied to air conditioners due to their higher efficiency, lower vibration, lower noise, smaller size, and lighter weight when compared to reciprocating or rotary type compressors.

Scroll compressors may be classified as a low pressure type or a high pressure type according to a method of supplying refrigerant into a compression chamber. More specifically, the low pressure type scroll compressor is configured such that refrigerant is indirectly sucked into a compression chamber through an inner space of a case. The inner space of the case is divided into a suction space and a discharge space. On the other hand, the high pressure type scroll compressor is configured such that refrigerant is directly sucked into a compression chamber, not through an inner space of a case, and is discharged to the inner space of the case. The inner space of the case may be a discharge space.

The scroll compressor may also be categorized as a tip seal type scroll compressor or a back pressure type scroll compressor according to a method of sealing a compression chamber. More specifically, the tip seal type scroll compressor is configured such that a tip seal installed on a wrap end of one scroll is upwardly moved to be adhered to an end plate of an opposite scroll when the compressor is operated. On the other hand, the back pressure type scroll compressor is configured such that a back pressure chamber is formed on a rear surface of one scroll and the scroll is adhered to an opposite scroll by a pressure in the back pressure chamber as oil or refrigerant having an intermediate pressure is introduced into the back pressure chamber. Generally, the tip seal method is applied to low pressure type scroll compressors, whereas the back pressure method is applied to high pressure type scroll compressors.

A rotation shaft of a drive motor may be coupled to one side surface of the orbiting scroll, and a wrap engaged with a fixed scroll may be provided on another side surface thereof. The orbiting scroll may be rotated in a state in which two side surfaces thereof come in contact with the fixed scroll and a main frame, respectively. In order to prevent vibration and to minimize frictional loss, the orbiting scroll may have a precisely processed shape. For this, a bearing surface that contacts the main frame may be processed first, and then a wrap portion may be processed. This may require a lot of time, and may cause damage to the bearing surface when processing the wrap portion. Further, since shapes and sizes of the orbiting scroll and the fixed scroll, in particular, a shape and size of the wrap portion have to be differently designed according to a capacity of a compressor, it takes a lot of time to design and fabricate the orbiting scroll.

Further, the pressure between the bearing plates of the orbiting scroll and the fixed scroll may depend on the pressure of the back pressure chamber. In order to prevent leakage of refrigerant and to minimize frictional loss, the back pressure should be maintained within a desired range. However, in a conventional scroll compressor, the entire orbiting scroll is supported only by the pressure of the back pressure chamber, which requires an increase in the pressure of the back pressure chamber. Thus, sealing performance between the orbiting scroll and fixed scroll may be greatly affected by a change in pressure of the back pressure chamber. In particular, the pressure of the back pressure chamber may be affected by the discharge pressure which may be changed by environmental factor of the compressor.

Figure 2:
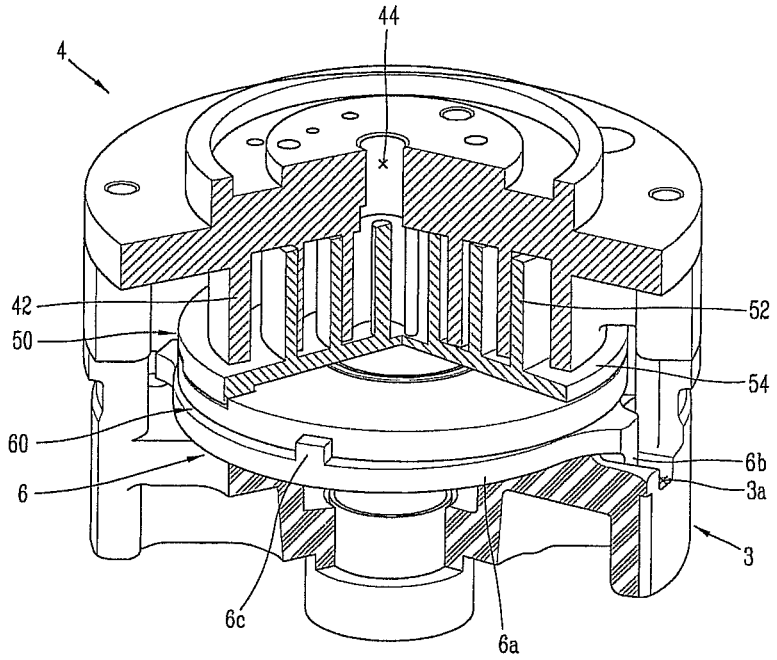
FIG. 2 is a partial enlarged view of a cut-out portion of a compression device of the scroll compressor of FIG. 1.
Figure 3:
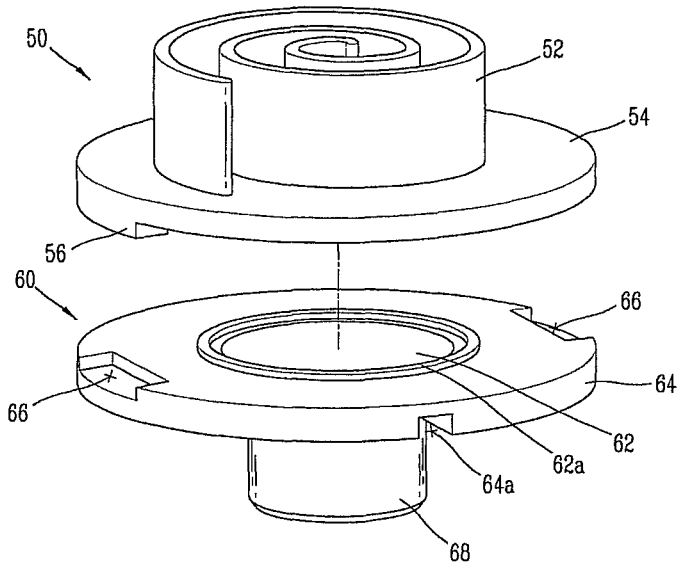
FIG. 3 is an exploded perspective view of an orbiting scroll of the scroll compressor of FIG. 1.

FIG. 1 is a cross-sectional view of a scroll compressor according to an embodiment. FIG. 2 is a partial enlarged view of a cut-out portion of a compression device of the scroll compressor of FIG. 1. FIG. 3 is an exploded perspective view of an orbiting scroll of the scroll compressor of FIG. 1.

As shown in FIGS. 1 to 3, the scroll compressor may include a case 1 having an inner space divided into a suction space 11, or lower pressure side, and a discharge space 12 or high pressure side. A drive motor 2 configured to generate a rotational force may be installed at or in the suction space 11 of the case 1. A main frame 3 may be fixedly installed between the suction space 11 and the discharge space 12 of the case 1. A fixed scroll 4 may be fixedly installed on an upper surface of the main frame 3. Between the main frame 3 and the fixed scroll 4, an orbiting scroll 5 may be installed, which may be eccentrically-coupled to a crank shaft 23 of the drive motor 2. The orbiting scroll 5 may form a pair of compression chambers (P), which consecutively move together with the fixed scroll 4. An Oldham ring 6 that prevents rotation of the orbiting scroll 5 may be installed between the fixed scroll 4 and the orbiting scroll 5.

A suction pipe 13 may be coupled to the suction space 11 of the case 1, so as to communicate therewith. A discharge pipe 14 may be coupled to the discharge space 12 of the case 1, so as to communicate therewith.

Although not shown, the case may be provided with a sealed discharge space, and may be divided into a suction space (low pressure side) and a discharge space (high pressure side) by a discharge plenum, which may be fixedly-coupled to the fixed scroll 4. Alternatively, an inner space of the case may be divided into a suction space and a discharge space by a high-low pressure separation end plate (not shown) fixed to an upper surface of the fixed scroll and adhered to an inner circumferential surface of the case.

The fixed scroll 4 may include an end plate 41, and a fixed wrap 42 that protrudes from a bottom surface of the end plate 41 and formed in an involute shape so as to form the compression chambers (P) together with an orbiting wrap 52 of the orbiting scroll 5. A suction port (not shown) may be formed on an outer circumferential surface of the end plate 41 of the fixed scroll 4, such that the suction space 11 of the case 1 may communicate with the compression chambers (P). A discharge port 44 may be formed at a central portion of the end plate 41 of the fixed scroll 4, such that the discharge space 12 of the case 1 may communicate with the compression chambers (P). Reference numeral 7 denotes a sub-frame, reference numeral 8 denotes a discharge valve, reference numeral 21 denotes a stator, and reference numeral 22 denotes a rotor.

Refrigerant may be introduced into the suction space 11, or the low pressure side, of the case 1 through the suction pipe 13 from the outside. Then, the low-pressure refrigerant in the suction space 11 may be introduced into the fixed scroll 4 through the suction port of the fixed scroll 4, and then moved to central portions of the orbiting scroll 5 and the fixed scroll 4 by the orbiting scroll 5. The refrigerant may be compressed and then discharged to the discharge space 12 of the case through the discharge port 44 of the fixed scroll 4. These processes may be repeatedly performed.

As shown in FIGS. 1-3, the orbiting scroll 5 may be divided into two parts. More specifically, the orbiting scroll 5 may include a wrap portion 50 engaged with the fixed scroll 4, and a base portion 60 coupled to the wrap portion 50. The wrap portion 50 may include the orbiting wrap 52, which may form the compression chambers (P) by being engaged with the fixed wrap 42, and a wrap flange 54, which may be integrally formed with the orbiting wrap 52. The wrap flange 54 may have a disc shape, and key-shaped portions 56 configured to be coupled to the base portion 60 may be formed at, for example, two sides of a bottom surface of the wrap flange 54.

The base portion 60 may be coupled to the wrap portion 50 facing a bottom surface of the wrap flange 54. More specifically, the base portion 60 may include a base flange 64, which may be formed in a disc shape like the wrap flange 54, and a boss portion 68 formed on a bottom surface of the base flange 64 and coupled to the crank shaft 23.

Key holes 66 configured to be coupled to the key-shaped portions 56 may be formed at edges of an upper surface of the base flange 64, respectively. As the key-shaped portions 56 may be inserted into the key holes 66, the wrap portion 50 may be moveable with respect to the base portion 60 in a direction of the crank shaft 23, but not moveable in a radial or circumferential direction of the base portion 60. Motion of the wrap portion 50 in an axial direction are restricted by a gap between the fixed scroll 4 and the main frame 3. Accordingly, the key-shaped portions 56 may be maintained in an inserted state in the key holes 66. More specifically, the wrap portion 50 and the base portion 60 may be stably coupled to each other by inserting the key-shaped portions 56 into the key holes 66, without using, for example, bolt-coupling or welding.

The Oldham ring 6 that prevents rotation of the orbiting scroll 5 may be coupled to a bottom surface of the base portion 60. More specifically, the Oldham ring 6 may be provided with a ring-shaped portion **6*a* that contacts a bottom surface of the base flange 64. A pair of first protrusions 6*b*, which may have a phase difference of approximately 180° from each other, may be formed at both sides of a bottom surface of the ring-shaped portion 6*a*. The first protrusions 6*b* may be inserted into first protrusion recesses 3*a* of the main frame 3. A pair of second protrusions 6*c*, which may have a phase difference of approximately 180° from each other, may be formed at both sides of an upper surface of the ring-shaped portion 6*a*. The second protrusions 6*c* may be inserted into second protrusion recesses 64*a* formed on a bottom surface of the base flange 64**.

With this configuration, even if a rotational force of the crank shaft 23 is transmitted to the base portion 60, the base portion 60 may perform an orbital motion, in a state of being prevented from rotating due to the Oldham ring 6. The wrap portion 50 coupled to the base portion 60 so as to have a restricted motion in a radial direction may also perform an orbital motion together with the base portion 60.

Figure 4:
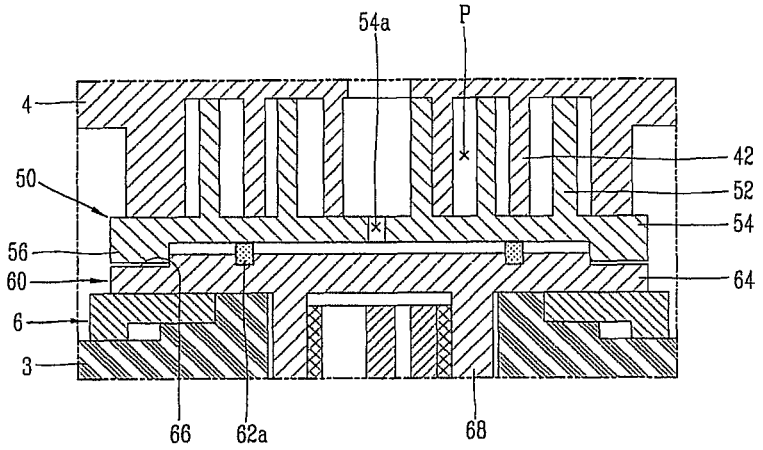
FIG. 4 is a sectional enlarged view of an orbiting scroll of the scroll compressor of FIG. 1.

A back pressure chamber 62, an inner space of which may be divided by an O-ring **62*a* may be formed at a central portion of an upper surface of the base flange 64. Referring to FIG. 4, the back pressure chamber 62 may be disposed between a bottom surface of the wrap flange 54 and an upper surface of the base flange 64. An inner space of the back pressure chamber 62 may be blocked from the low pressure side 11 by the O-ring 62*a*, which may be insertion-fixed to the base flange 64. A back pressure hole 54*a*, through which the inner space of the back pressure chamber 62 and the compression chambers P may communicate with each other, may be penetratingly formed at or in the base flange 64**.

During sucking and compressing of a refrigerant, compressed refrigerant in the compression chambers P may be partially introduced into the back pressure chamber 62 via the back pressure hole **54*a*. Since an inner pressure of the back pressure chamber 62 is higher than a peripheral pressure of the base flange 64, the base portion 60 may be upwardly moved from the wrap portion 50 in an axial direction. This may allow a sealing operation to be performed between a bottom surface of the fixed scroll 4 and the orbiting wrap 52**.

The inner pressure of the back pressure chamber 62 may be determined according to a position of the back pressure hole **54*a*. More particularly, when the back pressure hole 54*a* is moved so as to approach to a central portion of the orbiting wrap 52 of the orbiting scroll 5, the inner pressure of the back pressure chamber 62 may be is increased. On the other hand, when the back pressure hole 54***a* is moved toward the outside of the orbiting wrap 52 of the orbiting scroll 5, the inner pressure of the back pressure chamber 62 may be decreased.

Figure 5A:
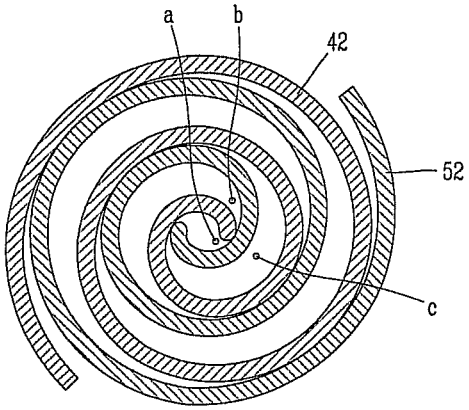
FIGS. 5A to 5C are planar views schematically illustrating processes for compressing a refrigerant in the scroll compressor of FIG. 1.
Figure 5B:
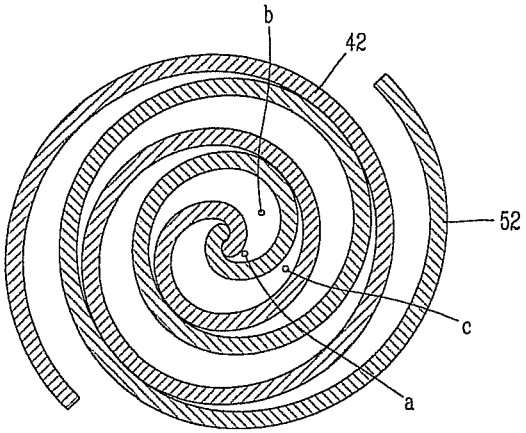
Figure 5C:
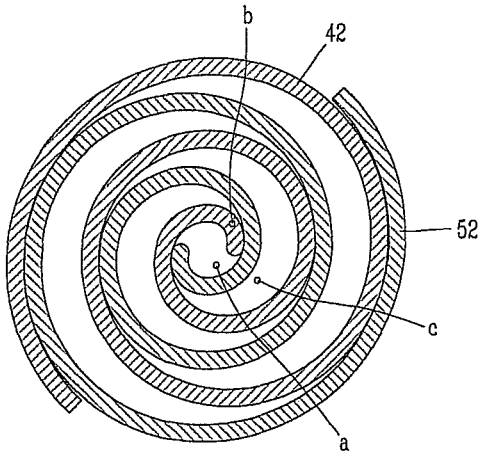

FIGS. 5A to 5C are planar views schematically illustrating processes for compressing a refrigerant by the orbiting wrap 52 and the fixed wrap 42 of the scroll compressor of FIG. 1. FIG. 5C illustrates an operation of starting a discharge process as a pressure in the compression chambers P reaches a discharge pressure. As aforementioned, the pressure in the compression chambers P formed by the orbiting wrap 52 and the fixed wrap 42 may be consecutively changed during a compression process. Accordingly, a pressure at an arbitrary point on the orbiting wrap 52 may also be consecutively changed during one compression cycle.

For instance, when the back pressure hole 54*a* is positioned at a point 'a' where a discharge pressure is applied during a compression process, the same pressure as the discharge pressure is applied to the back pressure chamber 62. In this case, a thrust force between a bottom surface of the fixed scroll 4 and the orbiting wrap 52 is large due to an excessive back pressure, resulting in great loss due to friction. Further, the discharge pressure varies according to an amount of a compression load applied to the compressor. Accordingly, when the back pressure hole 54*a* is positioned at a point 'a' where the discharge pressure is applied, the thrust force varies according to a load. This may influence performance of the compressor. More specifically, the point 'a' is within a range of a discharge start angle.

A point 'b' indicates a position where a discharge pressure is applied for a predetermined time and an intermediate pressure between a suction pressure and a discharge pressure is applied for the rest of the time. Accordingly, when the back pressure hole 54*a* is formed at the point 'b', a proper back pressure may be obtained. Further, even if the discharge pressure is changed due to a load change, etc., the discharge pressure may be compensated to some degrees due to the intermediate pressure. This may reduce influence on performance of the compressor due to load change. The point 'b' is within a range of approximately 180°, an involute phase difference from a discharge start angle of the orbiting wrap 52.

The point 'c' indicates a position where only an intermediate pressure is applied during a compression process. When the back pressure hole 54*a* is formed at the point 'c', the back pressure is too low to provide a high sealing performance. This may cause leakage of refrigerant.

Figure 6:
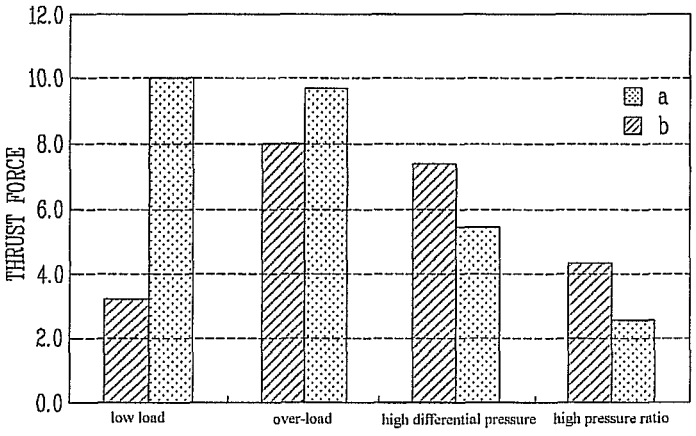
FIG. 6 is a graph illustrating a thrust force according to a position of a back pressure hole of the orbiting scroll of the scroll compressor of FIG. 1.

FIG. 6 is a graph illustrating each thrust force under conditions of a low load, an over-load, a high differential pressure, and a high pressure ratio when the back pressure hole is positioned at the points 'a' and 'b'. Referring to FIG. 6, when the back pressure hole 54*a* is positioned at the point 'a', an excessive thrust force is generated under a condition of a low load, and thrust forces under the other respective conditions have a large deviation from one another. On the other hand, when the back pressure hole is positioned at the point 'b', a small thrust force is generated under a condition of a low load, and thrust forces under the other respective conditions have a smaller deviation from one other.

Figure 7:
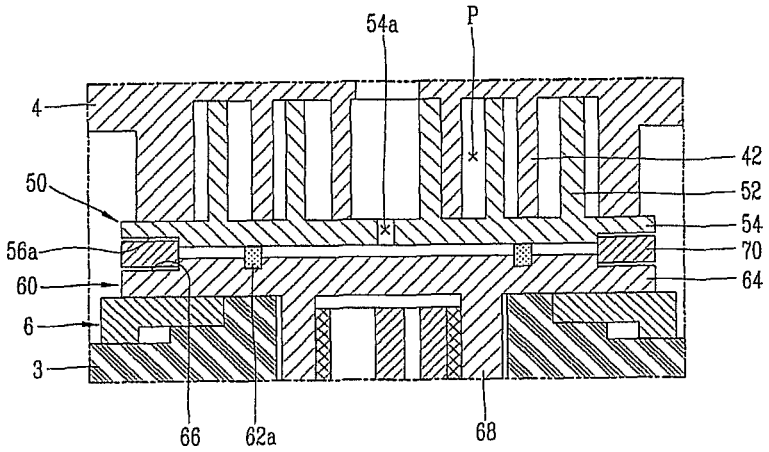
FIG. 7 is a cross-sectional view of an orbiting scroll according to another embodiment.

Alternatively to the previous embodiment, the key shape portion may be formed as a separate member. That is, as shown in FIG. 7, the key holes 56*a* may be formed on a bottom surface of the wrap flange 54, and keys 70 may be inserted into the key holes 56*a*, 66 of the wrap flange 54 and the base flange 64, respectively. A width of the key hole 56*a*, 66 may be smaller than that of the key 70, thereby the keys 70 may be fastened to the key holes 56*a*, 66 by, for example, an interference fit.

Figure 8:
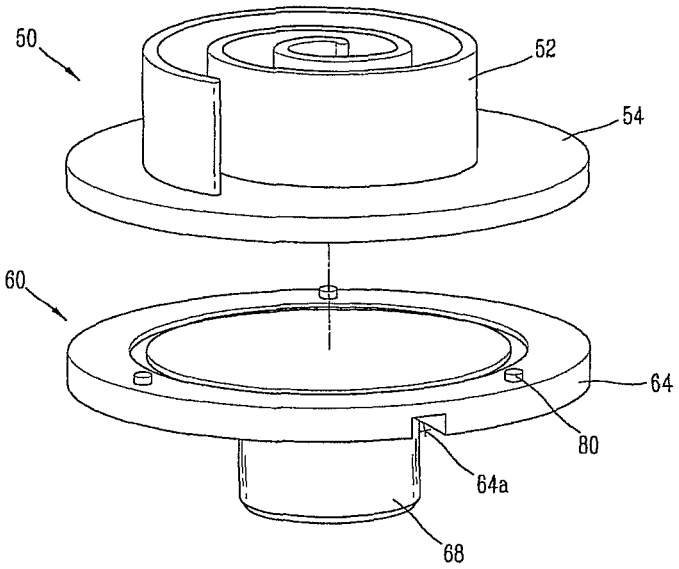
FIG. 8 is an exploded, perspective view of an orbiting scroll according to yet another embodiment.

According to another embodiment, a pin may be used instead of a key. That is, as shown in FIG. 8, pins 80 may be disposed on an upper surface of the base flange 64 with an interval of approximately 120° therebetween. The pins 80 may be integrally formed with the base flange 64 or separately formed from the base flange 64. The wrap flange 54 and the base flange 64 may be coupled to each other by inserting the pins 80 into pin holes (not shown) formed on a bottom surface of the wrap flange 54.

Figure 9:
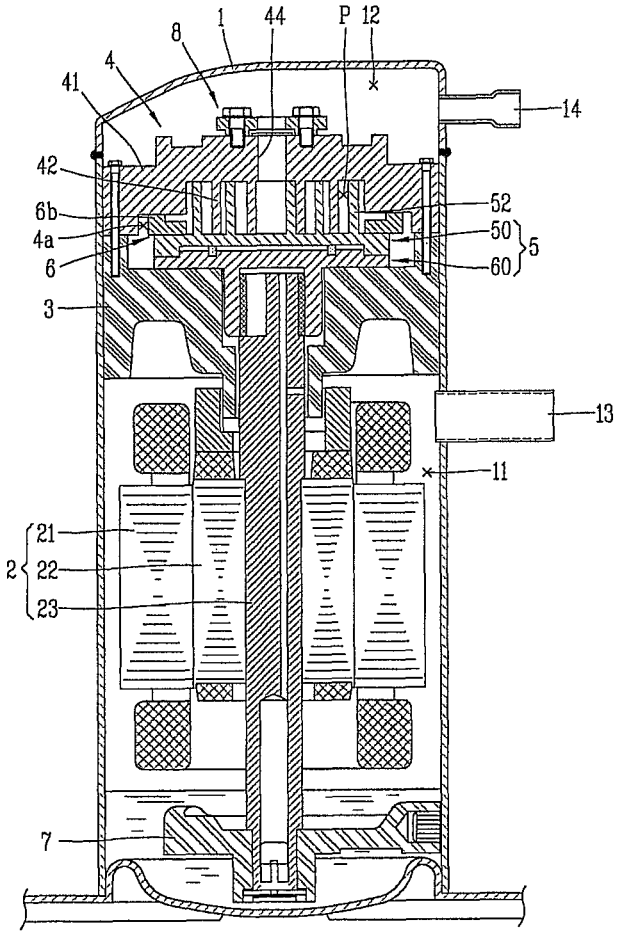
FIG. 9 is a cross-sectional view of a scroll compressor according to another embodiment.

Differently from the embodiment of FIG. 1, the Oldham ring 6 may be coupled to the fixed scroll 4, as shown in FIG. 9. FIG. 9 is a cross-sectional view of a scroll compressor according to another embodiment. Referring to FIG. 9, the Oldham ring 6 may be installed on the wrap portion 50 of the orbiting scroll 5, more specifically, on an upper surface of the wrap flange 54. For this, first protrusion recesses 4*a* configured to receive first protrusions 6*b* of the Oldham ring 6 may be formed on a bottom surface of the fixed scroll 4. This may fix the Oldham ring 6 so as not to rotate with respect to the fixed scroll 4. Second protrusions (not shown) of the Oldham ring 6 may be inserted into second protrusion recesses (not shown) of the wrap flange 54.

Different from the previous embodiments, the wrap portion and the base portion may be coupled to each other by, for example, welding or bolts. In this case, the wrap portion may be fixed so as not to be moveable with respect to the base portion. The Oldham ring may be coupled to an upper surface of the wrap portion or a bottom surface of the base portion.

Embodiments disclosed herein provide a scroll compressor that may ensure a desired sealing performance and minimize friction loss between an orbiting scroll and a fixed scroll in spite of load changes.

Embodiments disclosed herein provide a scroll compressor that may include a case; a fixed scroll installed in the case; a wrap portion configured to form a compression chamber by being engaged with the fixed scroll; a base portion coupled to the wrap portion in such a manner being movable to the fixed scroll and not rotating a circumferential direction; a drive motor coupled to a rear surface of the base portion, and configured to eccentrically rotate the base portion and the wrap portion; and a main frame installed in the case, and configured to support the base portion. A back pressure chamber that communicates with the compression chamber may be formed between the wrap portion and the base portion where a pressure of the back pressure chamber corresponds to a discharge pressure or an intermediate pressure between the suction pressure and the discharge pressure.

Embodiments disclosed herein provide a scroll compressor that may include a fixed scroll; an orbiting scroll including an orbiting wrap forming compression chambers together with the fixed scroll, and a coupling device or means that supports the orbiting wrap in such a manner being movable to the fixed scroll and not rotating a circumferential direction; and a pressing device or means disposed on a bottom surface of the orbiting wrap and forming a back pressure caused by introducing working fluid of the compression chamber thereinto in order to push the orbiting wrap toward the fixed scroll. The back pressure may be between a suction pressure and a discharge pressure.

The foregoing embodiments and advantages are merely exemplary and are not to be construed as limiting. The present teachings may be readily applied to other types of apparatuses. This description is intended to be illustrative, and not to limit the scope of the claims. Many alternatives, modifications, and variations will be apparent to those skilled in the art. The features, structures, methods, and other characteristics of embodiments described herein may be combined in various ways to obtain additional and/or alternative embodiments.

As the present features may be embodied in several forms without departing from the characteristics thereof, it should also be understood that the above-described embodiments are not limited by any of the details of the foregoing description, unless otherwise specified, but rather, should be construed broadly within the scope as defined in the appended claims, and therefore all changes and modifications that fall within the metes and bounds of the claims, or equivalents of such metes and bounds are therefore intended to be embraced by the appended claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a case having an inner space divided into a suction space and a discharge space;

a fixed scroll installed in the inner space of the case;

a wrap portion including an orbiting wrap that forms a plurality of compression chambers by being engaged with a fixed wrap of the fixed scroll, and a wrap flange formed with the orbiting wrap so as to have a one piece construction;

a base portion that includes a base flange coupled to the wrap flange so as to be movable with respect to the fixed scroll and not to rotate in a circumferential direction;

a drive motor that includes a crank shaft coupled to the base portion, and configured to eccentrically rotate the base portion and the wrap portion; and a main frame installed in the inner space of the case, and configured to support the base portion;

a discharge port formed in the fixed scroll in communication with at least one compression chamber of the plurality of compression chambers;

a back pressure chamber that communicates with the plurality of compression chambers formed between the wrap flange and the base flange; and at least one back pressure hole, through which the back pressure chamber and the at least one compression chamber of the plurality of compression chambers communicate with each other, is formed in the wrap flange and is positionally located on the wrap flange at which a discharge pressure and an intermediate pressure are applied thereto during operation of the scroll compressor when the fixed wrap and the orbiting wrap are engaged together, so that during the operation of the scroll compressor:

the discharge pressure received from the discharge port is applied into the back pressure chamber through the plurality of compression chambers and the at least one back pressure hole for a first period of time during a time period of a single compression cycle of the scroll compressor, and the intermediate pressure is applied into the back pressure chamber through the plurality of compression chambers and the at least one back pressure hole for a second period of time of the time period of the single compression cycle, wherein the second period of time is different from and non-overlapping with the first period of time, wherein the intermediate pressure has a value of pressure which is between a suction pressure of the scroll compressor and the discharge pressure of the scroll compressor, and wherein the discharge port is not in communication with the back pressure chamber during the time period of the single compression cycle except during the first period of time.

2. The scroll compressor or claim 1, wherein the base portion further includes a boss portion coupled to a rotation shaft of the drive motor, and wherein the back pressure chamber is provided in a space between a bottom surface of the wrap flange and an upper surface of the base flange.

3. The scroll compressor of claim 2, wherein a seal that seals the back pressure chamber is provided between the base flange and the wrap flange.

4. The scroll compressor of claim 3, wherein the seal includes an O-ring.

5. The scroll compressor of claim 1, wherein the wrap portion and the base portion are coupled to each other by a plurality of keys.

6. The scroll compressor of claim 5, wherein the plurality of keys is formed at or in at least one of the wrap portion or the base portion, and wherein a plurality of key holes configured to receive the plurality of keys, respectively, is formed at or in at least one of the other of the wrap portion and the base portion.

7. The scroll compressor of claim 5, wherein the plurality of keys is respectively coupled to a plurality of key holes by interference fitting.

8. The scroll compressor of claim 5, wherein the plurality of keys is fixed at or in the at least one of the wrap portion or the base portion by interference fitting.

9. The. scroll compressor of claim 1, wherein the case is partitioned into two spaces having different pressures from each other, and wherein the wrap portion and the base portion are provided in one space of the two spaces having a relatively lower pressure than the other space of the two spaces.

10. The scroll compressor of claim 9, wherein the case is partitioned into the two spaces haying different pressures from each other by the fixed scroll.

11. The scroll compressor of claim 1, wherein the at least one back pressure hole has an involute phase difference of 180° from a discharge start angle of the orbiting wrap.

* * * * *